US006182911B1

(12) United States Patent
Hanks et al.

(10) Patent No.: US 6,182,911 B1
(45) Date of Patent: Feb. 6, 2001

(54) INJECTION SPRAY SYSTEM WITH ADJUSTABLE METERING VALVE

(75) Inventors: Gordon K. Hanks, Salt Lake City; William D. Edwards, South Jordan, both of UT (US)

(73) Assignee: Bridgewater Corporation, Salt Lake City, UT (US)

( * ) Notice: Under 35 U.S.C. 154(b), the term of this patent shall be extended for 0 days.

(21) Appl. No.: 09/345,931

(22) Filed: Jul. 1, 1999

Related U.S. Application Data

(60) Provisional application No. 60/091,528, filed on Jul. 2, 1998.

(51) Int. Cl.[7] ..... B05B 7/30

(52) U.S. Cl. ..... 239/318; 239/340

(58) Field of Search ..... 239/310, 318, 239/337, 340, 417.5; 222/133, 145.7; 137/893, 556, 556.3, 556.6

(56) References Cited

U.S. PATENT DOCUMENTS

| | | | | |
|---|---|---|---|---|
| 1,987,883 | | 1/1935 | White et al. | 137/79 |
| 2,795,460 | | 6/1957 | Bletcher et al. . | |
| 2,874,719 | * | 2/1959 | Van Tuyl | 137/893 |
| 3,643,688 | | 2/1972 | Meinert | 137/556 |
| 3,762,439 | | 10/1973 | Heath | 137/549 |
| 3,763,888 | | 10/1973 | Duecker | 137/604 |
| 3,791,410 | | 2/1974 | Sapiano | 137/604 |
| 4,036,253 | | 7/1977 | Fegan et al. | 137/556 |
| 4,538,636 | | 9/1985 | Cleland | 137/216 |
| 4,883,086 | | 11/1989 | Lejnar | 137/399 |
| 4,901,765 | | 2/1990 | Poe | 137/893 |
| 5,301,718 | | 4/1994 | Bolhofner | 137/893 |
| 5,303,729 | | 4/1994 | DeMarco | 137/268 |
| 5,344,074 | | 9/1994 | Spriggs et al. | 239/10 |

* cited by examiner

*Primary Examiner*—Lesley D. Morris
(74) *Attorney, Agent, or Firm*—Workman, Nydegger & Seeley

(57) ABSTRACT

An injection spraying system includes a container having a compartment configured to hold a first fluid. A valve body is removably coupled with the container and includes a mixing chamber, an inlet passageway configured to deliver a second fluid to the mixing chamber, a discharge passageway extending from the mixing chamber, a stem compartment communicating with the mixing chamber through a control orifice, and a transition passageway in fluid communication with the stem compartment. Movably disposed within the stem compartment is a metering stem having a tapered nose configured to selectively engage the control orifice. An adjustment knob is mounted to the metering stem such that rotation of the adjustment knob selectively advances and retracts the metering stem within the chamber of the meter tube. A siphoning tube has one end disposed within the compartment of the container and an opposing end in fluid communication with the transition passageway.

25 Claims, 6 Drawing Sheets

INJECTION SPRAY SYSTEM WITH ADJUSTABLE METERING VALVE

The present application claims priority to U.S. Provisional Patent Application Serial No. 60/091,528, file Jul. 2, 1998 in the names of Gordon K. Hanks and William D. Edwards, which for purposes of disclosure is incorporated herein.

BACKGROUND OF THE INVENTION

1. The Field of the Invention

The present invention relates to injection spray systems, and more specifically injection spray systems having an adjustable valve for selectively metering concentrations of discharged fluid.

2. Present State of the Art

Throughout the arts, there are many instances where two or more fluids, such as liquids, must be proportionally combined and/or mixed to create a desirable output fluid. Many times one fluid is in a concentrated form and must be diluted to the proper strength for use. By providing devices which are capable of combining concentrated fluids with nonconcentrated fluids, individuals are able to purchase large quantities of concentrated fluids that can be diluted for use, thereby reducing costs associated with fluid use. One such type of device that combines fluids is an injection sprayer.

Injection sprayers are used in a variety of different environments for simultaneously mixing and spraying a liquid concentrate. For example, injection sprayers are often used in dispensing liquid fertilizers or pesticides on grass or agricultural products. Such injectors are also commonly used for dispensing cleaning or other additives on carpets. Various types of injection sprayers are available ranging in complexity from simple manually operated devices that may require minimal experience to highly complex devices that require computer operation or other technical experience.

Generally speaking, conventional injection sprayers include a container for holding the concentrated fluid. Mounted on the container is a valve that is selectively coupled to a hose providing a pressurized fluid such as water. As water passes through the valve, a venturi forms that draws or sucks the concentrate from within the container and mixes it with the stream of pressurized water. The mixed fluid is then subsequently dispensed from the end of the valve. This configuration has a unique benefit in that only the amount of concentrate that is actually used is mixed with the water. As a result, it is easy to maintain, carry, and store the concentrate.

Effective injection sprayers meter the concentrate into the water accurately and at a defined rate. That is, different concentrates are required to mix with water at different ratios. Concentration rate mixing varies with the flow rate of water through the valve. If inaccurate mixing occurs, the resulting output fluid may have either too high or too low a concentration. In either situation, there is a loss of time and an expense incurred for a user or operator.

In traditional injection sprayers, metering tips are removable attached to the end of the valve that siphons the concentrate from the container. The metering tips comprise tubular stems having a defined diameter. The diameter of the stem regulates the rate that the pressurized water draws the concentrate into the valve assembly. Accordingly, by attaching a metering tip of a desired diameter, a desired metering of concentrate is obtained.

Although this design is functionally effective, it has several limitations. Most notably, it is often necessary to change the metering of the concentrate based on differences in the pressure of the fluid and also the type of concentrate used. In the prior art, it is necessary to disassemble the container from the system and then manually replace the metering tip with a metering tip corresponding to the desired mixing rate. The manual replacement of metering tips is a time consuming process that requires the user to store a variety of differently sized metering tips. It is also undesirable to have to continually handle the metering tips that may have a chemical concentrate thereon.

OBJECTS AND BRIEF SUMMARY OF THE INVENTION

Accordingly, it is an object of the present invention to provide improved injection spray systems that can selectively meter an amount of concentrate to be added to a liquid stream.

Another object of the present invention is to provide the above systems that can selectively change concentrate metering without substantial disassembly of the system.

Yet another object of the present invention is to provide a metering valve for the above system that can function with high pressure fluid flows.

Still another object of the present invention is to provide a metering valve that eliminates the need for the replacement of different metering tips.

Yet another object of the present invention is to provide a metering valve that enables variable mixing of a concentrate with a liquid stream over a range of predefined mixing ratios.

Finally, another object of the present invention is to provide systems as above wherein corresponding metering valves enables variable mixing of a concentrate with a liquid stream over a range of predefined mixing ratios for different pressures.

To achieve the foregoing objects, and in accordance with the invention as embodied and broadly described herein, an injection spraying system is provided for mixing and dispensing a first fluid with a second fluid concentrate. The system includes a container having a compartment configured to hold the second fluid concentrate. A valve body is removably coupled with the container and includes a mixing chamber. A stationary alignment mark is located on an exterior of the surface valve body. An inlet passageway extends from the exterior to the mixing chamber. The inlet passageway is configured to deliver the first fluid to the mixing chamber from a pressurized hose. A discharge passageway extends from the mixing chamber to the exterior. A discharge hose and a gun jet are attached thereto.

A stem compartment is in fluid communication with the mixing chamber through a control orifice. Furthermore, a transition passageway is in fluid communication with the stem compartment. A siphoning tube has one end disposed within the compartment of the container and an opposing end in fluid communication with the transition passageway, thereby effecting fluid communication between the container and the mixing compartment.

Movably disposed within the stem compartment is a metering stem. A pair of annular grooves radially encircle the metering stem. Disposed within each groove is an O-ring. Each O-ring is configured to effect a sealed engagement between the metering stem and the interior surface of the stem compartment. The metering stem is configured to selectively control the flow of the second fluid from the transition passageway to the mixing chamber by selectively advancing and retracting within the stem compartment.

Finally, an adjustment knob is rigidly attached to the metering stem. The adjustment knob has a side face with a plurality of spaced apart indicia identifying discrete ratios of the first fluid to the second fluid. The adjustment knob is coupled with the metering stem such that alignment of a select indicia chosen from the plurality of indicia with the stationary alignment mark displaces the metering stem relative to the control orifice so that the first fluid and the second fluid feed into the mixing chamber at the ratio identified by the select indicia.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawing depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to an injection spray system used to deliver a mixture of a first fluid, such as water, with a second fluid, such as a concentrated cleaning solution or the like. The injection spray system generally includes a container capable of holding a quantity of the second fluid concentrate. A metering valve is fluid coupled with the container through a siphoning tube. As the first fluid is passed through the metering valve at an elevated pressure, a venturi is created that sucks and mixes the second fluid concentrate into the first fluid. The mixed fluids are then dispensed from the metering valve.

Various proportions of concentrate and water are possible through use of the metering valve. Specifically, for a given pressure of the first fluid, the metering valve can be used to repeatedly and accurately produce a variety of predetermined ratios of the first fluid to the second fluid. Additionally, the metering valve can be adapted to repeatedly and accurately produce a variety of predetermined ratios of the first fluid to the second fluid for different pressures of the first fluid. The metering valve of the present invention is also designed to prevent air from being drawn into the injection spray system which can affect the mixing ratios of the fluids.

The figures and the following discussion are intended to provide a brief, general description of the injection spray system of the present invention. The present invention will be described in the context of one particular embodiment using a concentrated fluid as the first fluid and water as the second fluid. It can be appreciated, however, that the invention may be practiced in various forms in light of the teachings contained herein and known by those skilled in the art.

Figure 1:
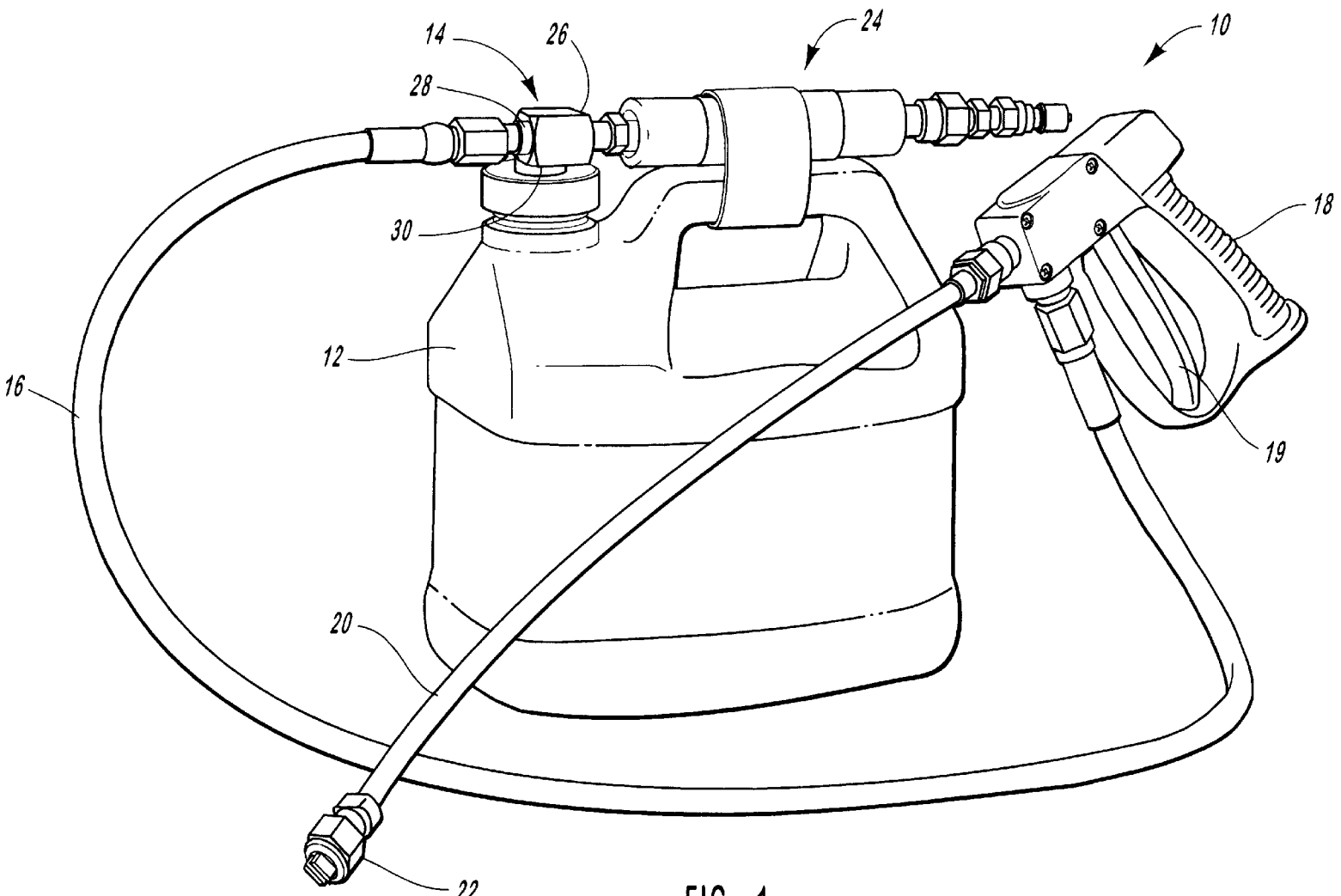
FIG. 1 is a perspective view of an injection spray system.

As shown in FIG. 1, the inventive injection spray system 10 includes a container 12 configured to hold a first fluid. Attached to container 12 is a metering valve 14 that controls the mixing rate of the first fluid water stream to a second fluid concentrate. Metering valve 14 has an inlet end 26, an outlet end 28, and a siphoning end 30. Projecting from inlet end 26 is an adapter assembly 24 that controls the flow of water into metering valve 14. Siphoning end 30 cooperates with container 12 to allow the second fluid concentrate to flow therefrom.

Protruding from outlet end 28 of metering valve 14 is a dispensing hose 16. Dispensing hose 16 directs the concentrate/water mixture created by metering valve 14 towards a hand-operated gun jet 18. The gun jet 18 controls the rate of discharge of the concentrate/water mixture from the injection spray system 10. As shown, gun jet 18 includes a tubular extension 20 that projects therefrom and terminates at a spray head 22. Spray head 22 in cooperation with the depression of a trigger 19 of gun jet 18 regulates the dispersion pattern of the concentrate/water mixture exiting from injection spray system 10. Various configurations and embodiments of gun jet 18 are known by those skilled in the art.

Figure 2:
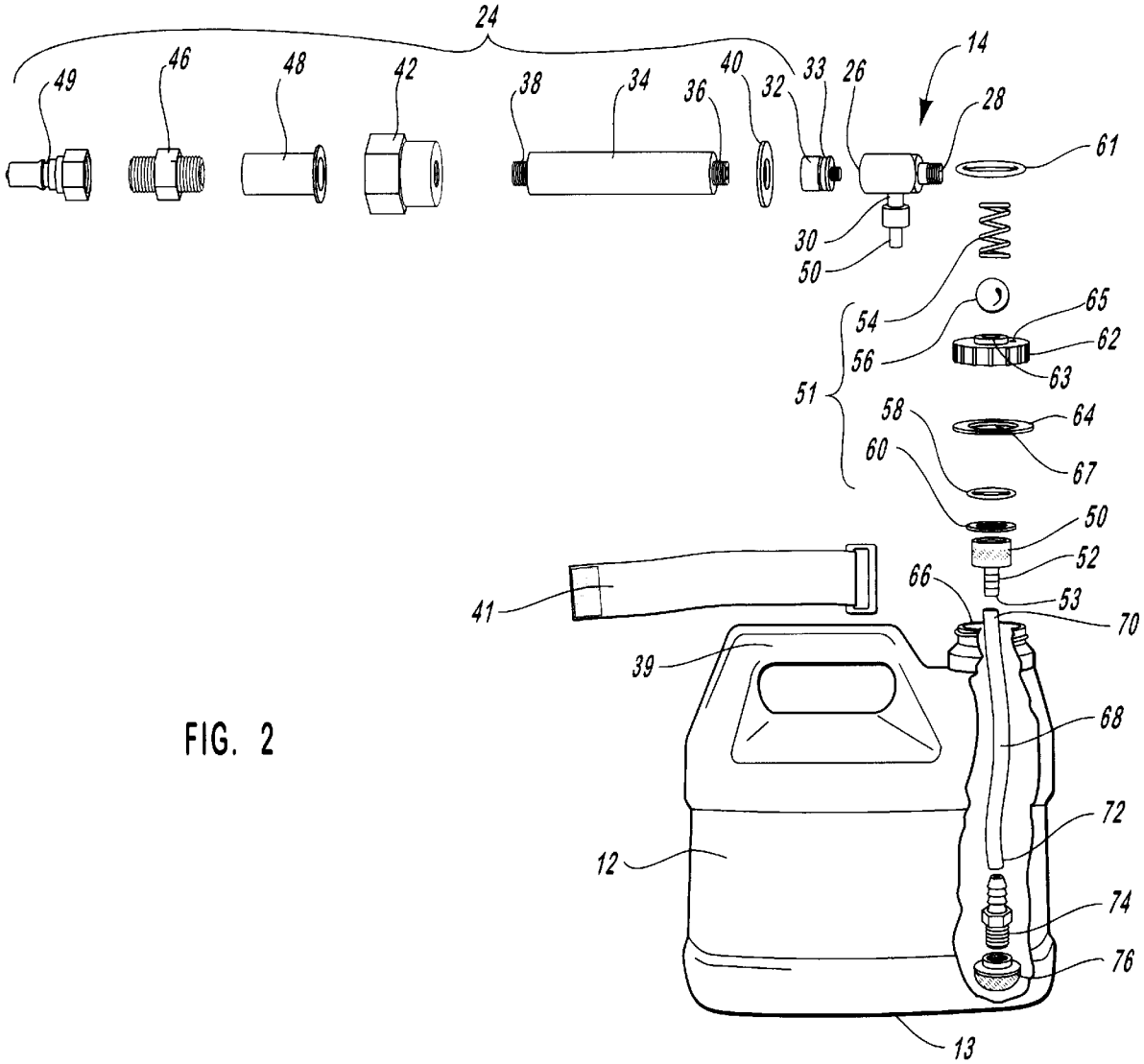
FIG. 2 is an exploded perspective view of the injection spray system depicted in FIG. 1.

Depicted in FIG. 2, container 12 bounds a compartment 13 in which the first fluid is disposed. A handle 39 is provided by which a user manually positions or carries container 12, and more generally injection spray system 10. Handle 39, therefore, many have numerous sizes and dimensions to allow a user to easily carry and position container 12 and/or injection spray system 10.

One skilled in the art can identify various other configurations of container 12 that are capable of performing the function thereof. For example, container 12 may have various sizes and dimensions, such as by way of example and not limitation, square, rectangular, circular, ovular, trapezoidal, triangular, or the like cross-sections so long as container 12 securely retains the concentrate therein. Furthermore, container 12 may retain numerous types of fluids such as, by way of example and not limitation, liquid fertilizers or pesticides for grass or agricultural products, carpet additives or cleaning solutions, and the like. Additionally, container 12 may be formed of various materials that are capable of retaining the desired structural shape while not reacting with the fluid placed within. The materials range from plastics, composites, metals, synthetics, or the like. It is preferable that container 12 by substantially composed of plastic.

Compartment 13 communicates with the exterior through an opening 66. A cap 62 is configured to threadedly mate with container 12 so as to at least partially cover opening 66. As discussed below in greater detail, cap 62 bounds a mounting aperture 63 and a vent hole 65, each of which extend through cap 62. Disposed on the inside of cap 62 so as to cover vent hole 65 is a cap liner 64. Cap liner 64 has an aperture 67 disposed in alignment with mounting aperture 63. Cap liner 64 helps to prevent fluid within container 12 from spilling out through vent hole 65 but permits air outside of container 12 to be sucked through vent hole 65 and into container 12 as the fluid is being drawn out of container 12.

Threadedly attached to siphoning end 30 of metering valve 14 is tubular attachment fitting 50 having a tubular barbed stem 52 projecting therefrom. Attachment fitting 50 bounds a passageway 53 that longitudinally extends therethrough. Prior to securing attachment fitting 50 to siphoning end 30, a sealing ring 61 is positioned around siphoning end 30. Siphoning end 30 is then passed through mounting aperture 63 of cap 62 and aperture 67 of cap liner 64. Attachment fitting 50 is then secured to siphoning end 30. As a result of attachment fitting 50 being larger than mounting aperture 63, attachment fitting 50 functions as a top that permits cap 62 to rotate freely but precludes cap 62 from sliding off siphoning end 30. Sealing ring 61 functions to seal any gap between cap 62 and siphoning end 30 at mounting aperture 63.

Various configurations of attachment fitting 50 are known by one skilled in the art. For example, fitting 50 can slip-fit couple with siphoning end 30. In another configuration, fitting 50 snap-fits with siphoning end 30. In still yet another configuration, fitting 50 includes spring-loaded portions that cooperate with complementary apertures formed in siphoning end 30. In yet another configuration, fitting 50 includes complementary apertures that cooperate with spring-loaded portions in siphoning end 30. Barbed stem 52, in another configuration, can slip fit with cap 62. In another configuration, barbed stem 52 slip fits with siphoning tube 68. In yet another configuration, barbed stem 52 is threaded and cooperates with a threaded portion on either cap 62 or siphoning tube 68. Generally, one skilled in the art can identify various other methods or means of attaching, whether releasably or not, fitting 50 to siphoning end 30.

Also disposed between attachment fitting 50 and siphoning end 30 of metering valve 14 is a check valve assembly 51. As depicted, check valve assembly 51 has a spring 54 and a ball 56. Spring 54 biases ball 56 against the opening of passageway 53 within barbed stem 52 as fitting 50 attaches to siphoning end 30. Check valve assembly 51 prevents the passage of the concentrate into metering valve 14 prior to the flow of the water. To effect a proper seal and aid in the operation of check valve assembly 51, a spacer 58 and an O-ring 60 are disposed between fitting 50 and siphoning end 30. Various other configurations of check valve assembly 51 are known to one skilled in the art, in light of the teachings contained herein.

Mounted on barbed stem 52 of attachment fitting 50 is a first end 70 of a flexible siphoning tube 68. An opposing second end 72 of siphoning tube 68 attaches to a barbed connector 74. In turn, an acorn strainer 76 is coupled with connector 74. Acorn strainer 76 prevents contaminants from passing into metering valve 14 as concentrate flows therethrough. Generally speaking, acorn strainer 76 is one structure of straining means for removal of contaminants from the second fluid. During use, second end 72 of siphoning tube 68, having acorn strainer 76 and connector 74 thereon, is feed through opening 66 in container 12 until cap 62 engages therewith. Cap 62 is then selectively rotated so as to threadedly engage with container 12. In this way, the second fluid within container 12 is in communication with metering valve 14 through siphoning tube 68.

One skilled in the art can identify various other configurations of siphoning tube 68, barbed connector 74, and acorn strainer 76. For example, siphoning tube 68 can be formed with an integral acorn strainer 76 thereby eliminating the need for barbed connector 74. In another configuration, barbed connector 74 is integrally formed with acorn strainer 76. In another configuration, siphoning tube 68 is rigid rather then being flexible. In yet another configuration, injection spray system 10 included multiple siphoning tubes 68, barbed connectors 74, and acorn strainers 76. In still yet another configuration, multiple siphoning tubes 68 cooperate with a single acorn strainer 76. Various materials may form siphoning tube 68, barbed connector 74, and acorn strainer 76, as known by one skilled in the art. The materials range from plastics, metals, composites, meshes of the same, mixtures of the same, or the like.

Referring again to FIG. 2, fluid coupled with inlet end 26 of metering valve 14 is adapter assembly 24 having a constricting nozzle 32. Nozzle 32 has a generally circular cross-section provided with tapered sides and a bore (not shown) passing therethrough. The bore of nozzle 32 limits the flow of the water into metering valve 14. Various sizes and dimensions of the bore are applicable to vary the flow rate of water therein. Surrounding the exterior of nozzle 32 is a sealing member 33 that creates a fluid tight seal upon insertion of nozzle 32 within inlet end 26 of metering valve 14. As such, nozzle 32 has complementary dimension to those of inlet end 26.

Nozzle 32 can be formed from various materials, so long as they are capable of withstanding the pressure and corrosive characteristics associated with flowing fluids. The materials range from plastics, composites, metals, and mixtures of the same, or the like. It is preferable that nozzle 32 be substantially composed of brass.

Fluid coupled with nozzle 32 are the remaining elements of adapter assembly 24. Adapter assembly 24 further includes an insulated tubular extension 34 having a first end 36 and an opposing second end 38. Extension 34 is removably attached to handle 39 of container 12 by a VELCRO® strap 41 or some other attachment means for positioning adapter assembly 24 in cooperation with the container 12. Other attachment means could include, but are not limited to, complementary snaps and hooks on handle 39 and part of adapter assembly 24, releasable and reattachable adhesives, clasps or clips, or the like.

First end 36 of extension 34 secures to nozzle 32 while coupling to inlet end 26 of metering valve 14. Disposed between first end 36 and inlet end 26 of meting valve 14 is an O-ring 40 that cooperates with both the threaded portions of first end 36 and inlet end 26 and sealing member 33 of nozzle 32 to create a fluid tight seal. One skilled in the art can identify various other components or methods for creating a fluid tight seal, such as for example, TEFLON tape, brazing, chemical bonding, sonic bonding, thermal bonding, adhesives, mechanically formed seals, a combination of the above, or the like.

A strainer adapter 42 couples to second end 38 of extension 34 through complementary threaded ends. A strainer body 46 similarly attaches to strainer adapter 42 to thereby secure a strainer 48 therebetween. Strainer 48 prevents contaminants carried within the water or second fluid from entering into metering valve 14. By reducing the quantity of contaminants that pass into metering valve 14, strainer 48 substantially eliminates the possibility of blockage or restricted flow through metering valve 14. It can be appreciated that multiple strainers 48 can be located between strainer adapter 42 and strainer body 46. Strainer 48 is another configuration of straining means for removal of contaminants from a fluid. Additionally, the combination of strainer adapter 42, strainer body 46, and strainer 48 comprise another structure of straining means. Other configurations of straining means are known by those skilled in the art.

Various other configurations of providing strainer 48 within injection spray system 10 are known by those skilled in the art in light of the teaching container herein. For example, strainer 48 can be integrally formed with tubular extension 34. In another configuration, strainer adapter 42 and strainer body 46 are coupled together by way of a slip fit. In yet another configuration, strainer adapter 42 and strainer body 46 are integrally formed together with strainer 48 formed therebetween.

Strainer adapter 42, strainer body 46, and strainer 48 may have various sizes and dimensions, such as by way of example and not limitation, square, rectangular, circular, oval, trapezoidal, triangular, or the like cross-sections so long as they are capable of performing the desired function of preventing contaminants from flowing into metering valve 14, while cooperating with the other elements of injection spray system 10. Additionally, strainer adapter 42, strainer body 46, and strainer 48 may be formed of various materials that are capable of withstanding the forces and stresses associated with fluid flows, while being inactive with respect to the fluid flowing. The materials range from plastics, composites, metals, mixtures thereof, or the like. The mesh size of strainer 48 may be varied as necessary to prevent the flow of particular contaminants, including bacteria if necessary.

As depicted in FIG. 2, attached to the free end of the strainer body 46 is a male or female quick connect 49. Quick connect 49 or strainer body 46 can selectively couple with an inlet hose (not shown), such as a conventional garden hose that provides a source of water or first fluid. Alternatively, the inlet hose can comprise a high pressure hose that selectively couples with a compressor that feeds pressurized water or some other fluid to metering valve 14. One skilled in the art can identify various other configurations of quick connect 49.

For example, inlet hose can be integrally formed with strainer body 46 such that upon release of strainer body 46 from strainer adapter 24, the inlet hose is released from injection spray system 10,. In yet another configuration, the end of the inlet hose is formed as quick connect 49. In still yet another configuration, the injection spray system 10 does not include quick connect 49. In another configuration, inlet hose can be fixably attached to strainer body 46 such that it is not removable therefrom.

Figure 3:
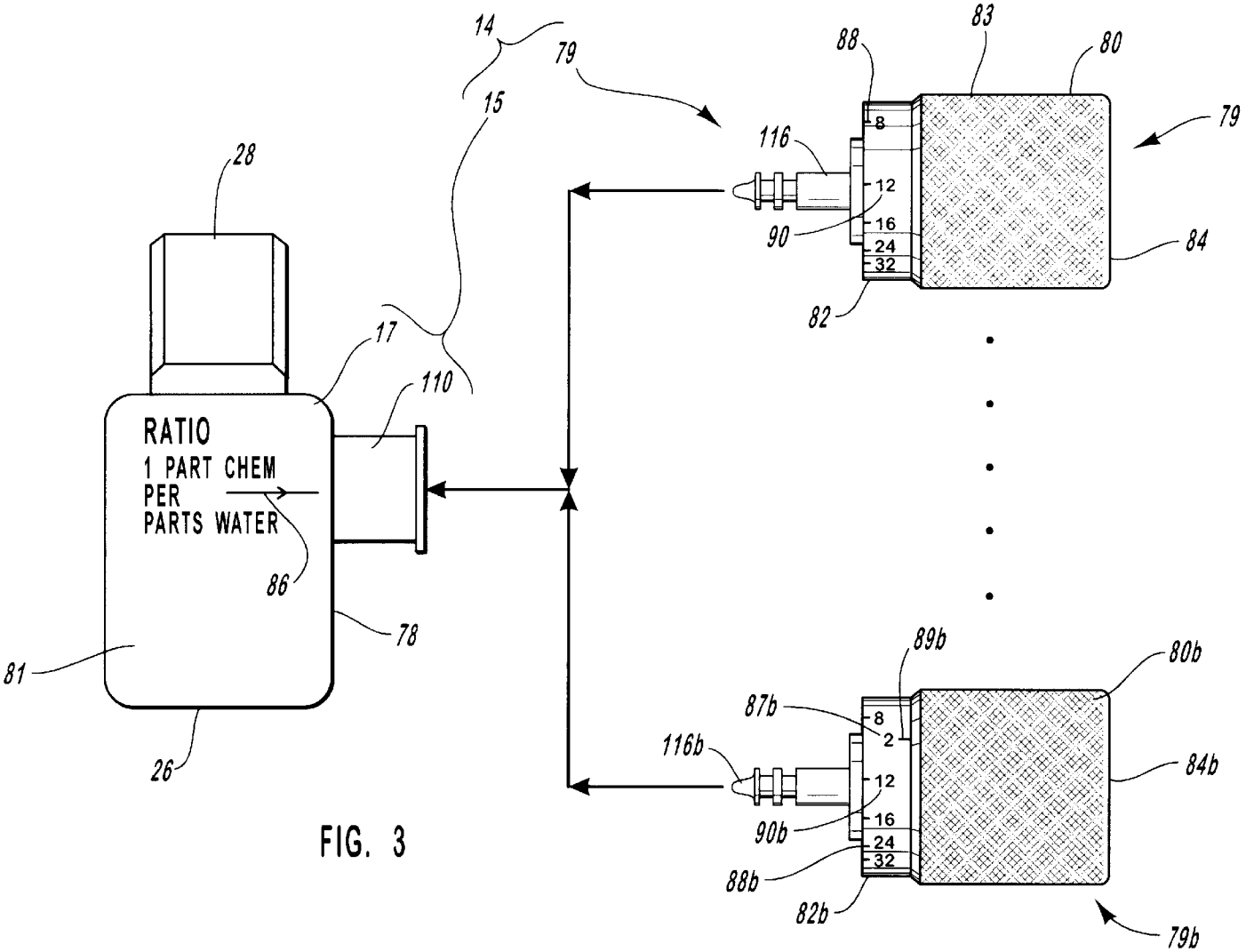
FIG. 3 is a top view of the metering valve in the system shown in FIG. 1 having two discrete adjustment knobs for different fluid pressures.

Depicted in FIG. 3, metering valve 14 comprises a valve body 15 and a control assembly 79. In turn valve body 15 includes a valve housing 17 having a substantially cylindrical meter tube 110 projecting from a side 78 thereof. Valve housing 17 has a top surface 81 with a stationary alignment mark 86 formed thereon. Stationary alignment mark 86 acts as a reference point for regulating the mixing ratio of the first fluid and the second fluid.

Mounted to valve body 15 is a select one of two or more control assemblies 79. By way of example, control assemblies 79 and 79*b* are depicted herein. Although control assembly 79 is primarily discussed herein, it is appreciated that like elements are represented by like reference characters between control assemblies 79 and 79*b*.

Control assembly 79 includes an adjustment knob 80 having an elongated metering stem 116 projecting therefrom. As discussed later in greater detail, control assembly 79 is rotatably mounted to valve body 15 with metering stem 116 being at least partially disposed within meter tube 110 and meter tube 110 being at least partially disposed within adjustment knob 80.

Adjustment knob 80 has a substantially cylindrical configuration with a side face 83 longitudinally extending from a first end 82 to an opposing second end 84. Adjustment knob 80, however, may have various other cross-sectional shapes and dimensions as desired by a user, such as, by way of example and not limitation, oval, square, rectangular, trapezoidal, or the like.

Disposed on side face 83 adjacent to first end 82 so as to at least partially encircle adjustment knob 80 are a plurality of discrete spaced apart indicia 90. A metering mark 88 is disposed between each indicia 90 and first end 82. Each indicia 90 is a discrete number. When metering mark 88 of a select indicia 90 is aligned with alignment mark 86, the number of the select indica defines the ratio at which the first fluid will mix with the second fluid concentrate when the first fluid is passed through valve body 15 at a predetermined pressure and flow rate. For example, rotation of adjustment knob 80 such that the stationary alignment mark 86 is aligned with indicia 90 corresponding to the number twelve will result in the first and second fluids being mixed together at a ratio of one part of the second fluid concentrate to twelve parts of the first fluid, or visa versa. By further rotating adjustment knob 80, the ratio at which the second fluid mixes with the first fluid changes. Accordingly, by selectively aligning a specific indicia 90 with alignment mark 86, a user is able to select a desired mixing ratio for nay given first fluid concentrate.

Indicia 90 on adjustment knob 80 are positioned based on a predetermined pressure at which the first fluid enters metering valve 14. For example, indicia 90 can be set for any pressure ranging from 100 psi to 1000 psi. In one preferred embodiment, indicia 90 is set for a pressure of 300 psi. To accommodate different pressures, different adjustment knobs 80 can be used. For example, indicia 90*b* on adjustment knob 80*b* are either positioned at different locations or have different numbers so as to reflect the appropriate mixing ratios for a given pressure of the first fluid that is different than the first fluid pressure associated with adjustment knob 80. By way of example, indicia 90 on adjustment knob 80 can be scaled for a first fluid pressure of 300 psi while indicia 90*b* on adjustment knob 80*b* can be scaled for a first fluid pressure of 600 psi. Although each adjustment knob 80 is set for a specific pressure, each adjustment knob 80 can be used over a range of pressures with only a small degree of error. As such, adjustment knob 80 can be used over a pressure range from 200 psi to 400 psi with minimal error in the defined mixing ratios.

As also depicted in FIG. 3, adjustment knob 80*b* has indicia 87*b* with a metering mark 89*b* positioned towards second end 84*b*. Indicia 87*b* having such metering marks 89*b* define ratios that are correct only after one complete rotation of adjustment knob 80*b*. Thus, some indicia define ratios during the first rotation of the adjustment knob while other indicia define ratios during the second rotation of the adjustment knob.

One skilled in the art can identify various other configurations of adjustment knobs 80 with associated metering marks and indicia. For example, adjustment knobs 80 can be formed as thumb wheels such that rotation of the thumb wheel performs the same alignment of marks 86 and 88. In another configuration adjustment knobs 80 take the form of sliders that control the flow of fluid from within container 12. As the slider moves a greater or lesser quantity of fluid is drawn from container 12. In still yet another configuration, stationary alignment mark 86 and metering marks 88 are encompassed within a liquid crystal display (LCD) such that upon movement of adjustment knobs 80 or sliders, the LCD depicts the mixture proportions.

Figure 4:
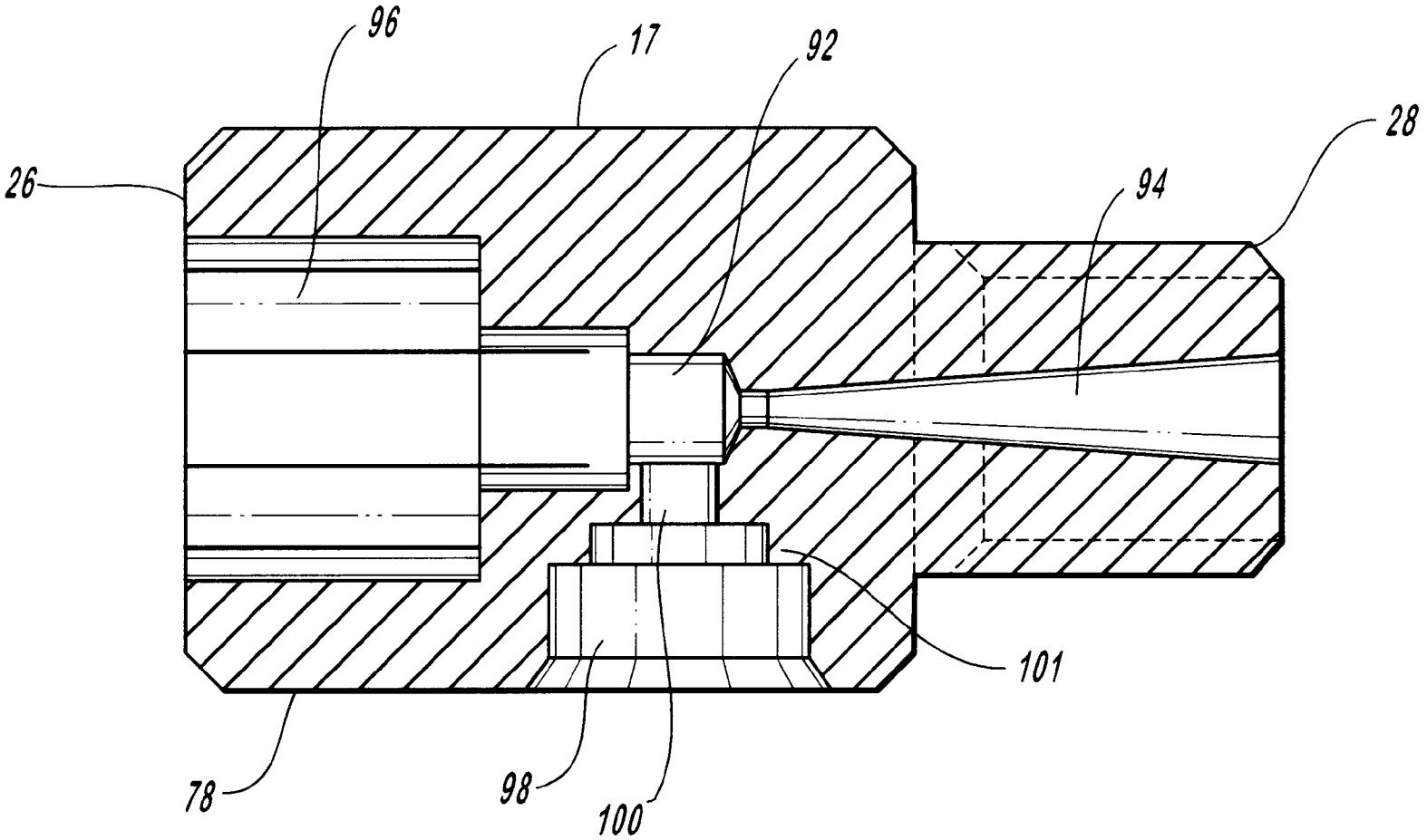
FIG. 4 is a cross sectional top view of a valve housing of the metering valve shown in FIG. 3.

Depicted in FIG. 4 is a cross-sectional top view of valve housing 17 with control assembly 79 and meter tube 110 removed therefrom. Disposed within valve housing 17 is a generally cylindrical mixing chamber 92 located between inlet end 26 and outlet end 28. In alternative embodiments, mixing chamber 92 need not have a generally cylindrical form, but rather can have an oval, rectangular, square, trapezoidal, or the like cross-sectional dimension.

Extending from mixing chamber 92 through outlet end 28 is a radially outwardly expanding discharge passageway 94. A concentrically constricting inlet passageway 96 extends from inlet end 26 to mixing chamber 92. As shown, discharge passageway 94 and inlet passageway 96 are axially aligned, however, discharge passageway 94 and inlet passageway 96 need not be axially aligned. Furthermore, the size and configuration of mixing chamber 92, discharge passageway 94, and inlet passageway 96 may be varied as necessary and known by one skilled in the art to perform the desired function. For example, mixing chamber 92 need not be a discrete compartment but may be a portion of either discharge passageway 94 or inlet passageway 96. In general, mixing chamber 92 is simply the location where the first fluid and the second fluid intersect within valve housing 17.

Figure 5:
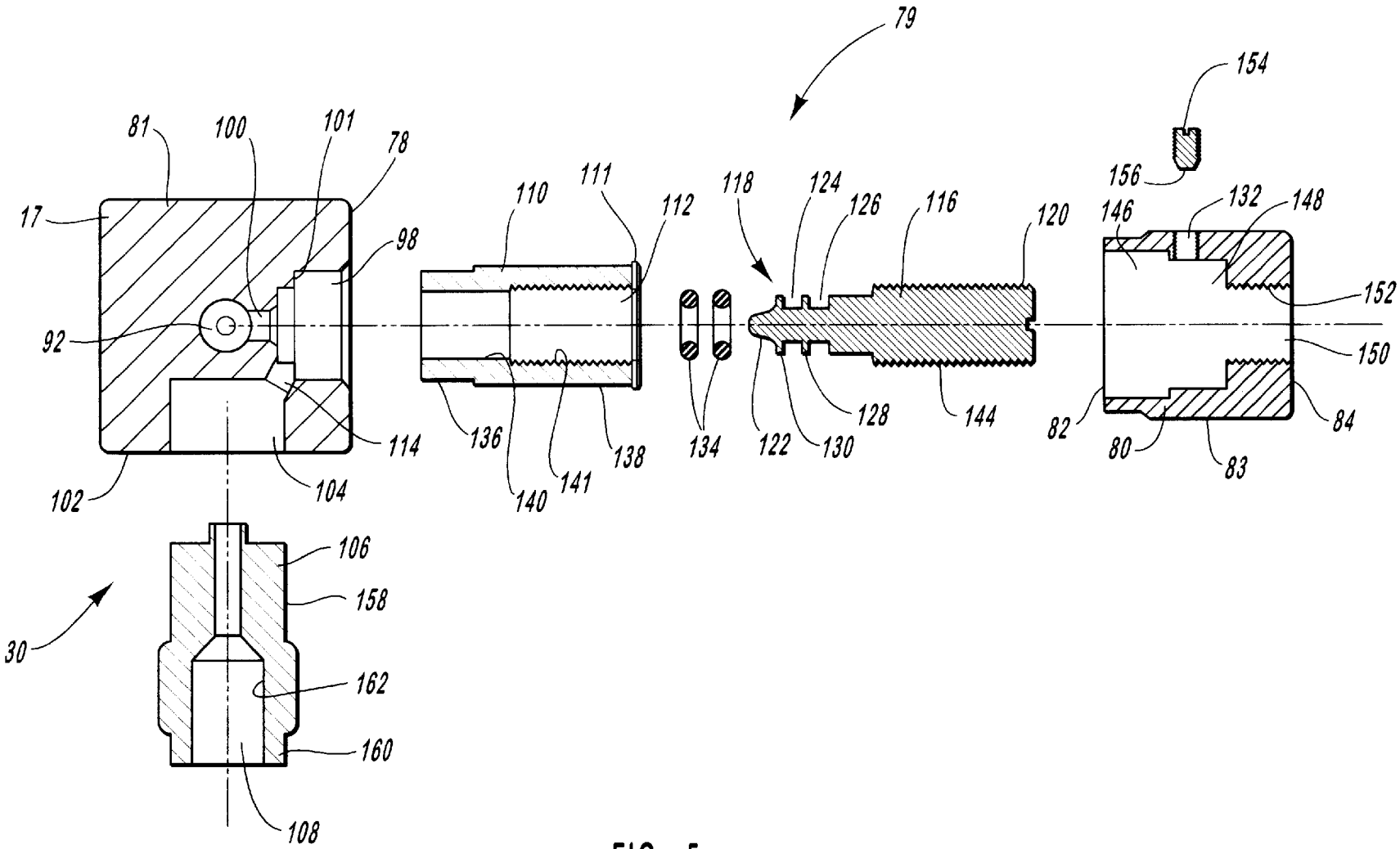
FIG. 5 is a front cross sectional exploded side view of the metering valve shown in FIG. 3.

Extending generally perpendicularly to the axis of discharge passageway 94 and inlet passageway 96 is a control orifice 100. Control orifice 100 has a generally cylindrical form and axially coincides with an enlarged control recess 98 that extends from control orifice 100 to side 78 of valve housing 17. An annular shoulder 101 radially inwardly projects from control recess 98 adjacent to control orifice 100. As depicted in FIG. 5, a cylindrical siphon recess 104 is formed in a bottom surface 102 of valve housing 17. Extending from siphon recess 104 to control recess 98 is a transition passageway 114. As such transition passageway 144 enables fluid communication between siphon recess 104 and mixing chamber 92.

Figure 6:
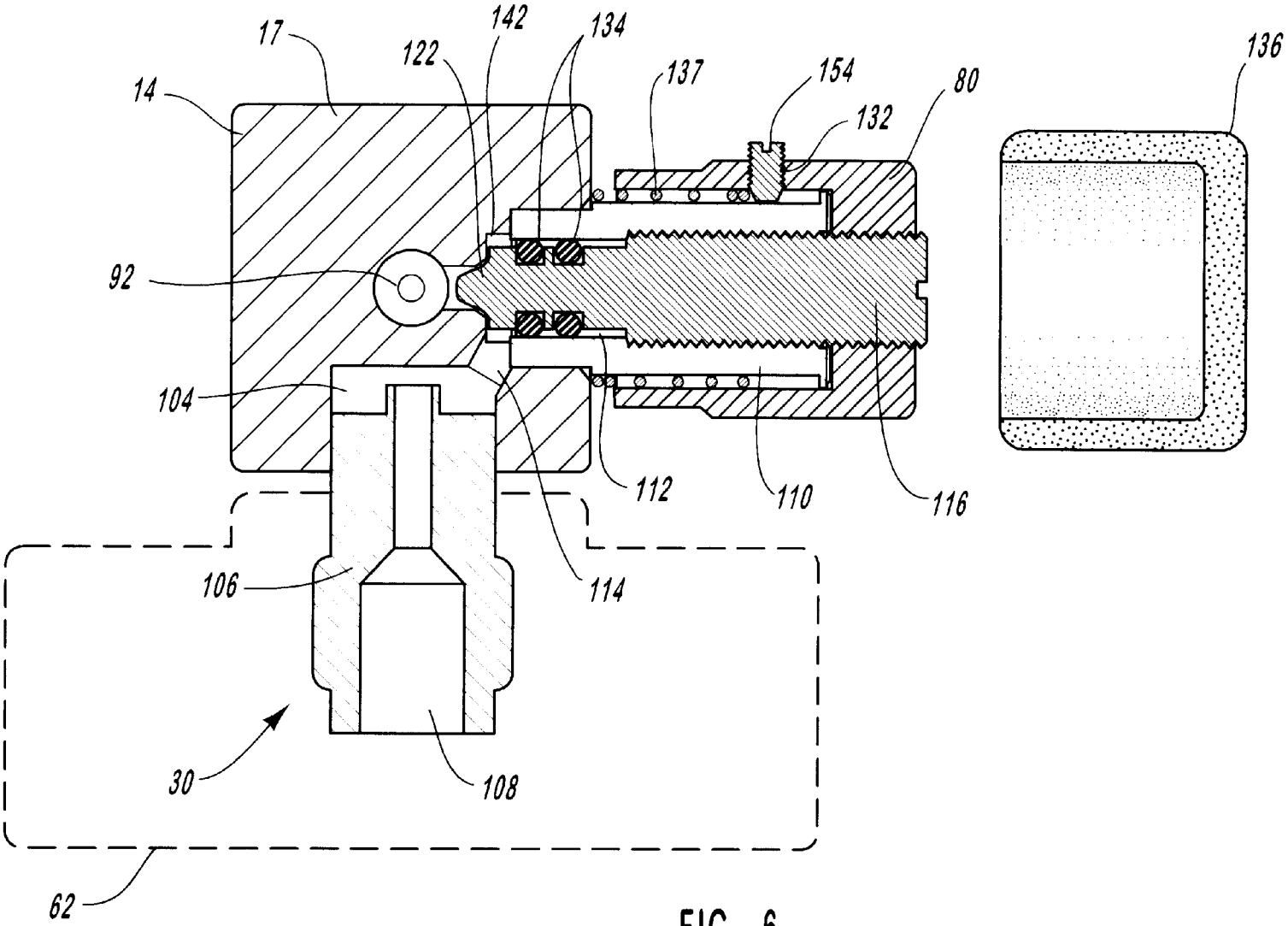
FIG. 6 is a front cross sectional side view of the metering valve shown in FIG. 3 in an assembled condition.

As also depicted in FIG. 5, meter tube 110 has a generally cylindrical form with a interior surface 140 that bounds a chamber 112. Chamber 112 extends from a first end 136 to an opposing second end 138. Formed on interior surface 140 at second end 130 are a first set of threads 141. Radially outwardly projecting from the exterior surface of meter tube 110 at second end 140 is an annular lip 111. As depicted in FIG. 6, first end 136 of meter tube 110 is secured within control recess 98 so as to bias against annular lip 111. In this configuration, chamber 112 is in fluid communication with mixing chamber 92. Chamber 112 and any portion of control recess 98 not covered by meter tube 110 form a stem compartment 142 in which metering stem 116 is movably disposed. Meter tube 110 can be either removably secured within control recess 98, such as by threaded engagement, or fixed secured, such as by adhesive or some form of welding.

Depicted in FIG. 5, metering stem 116 has a substantially cylindrical form and extends from a first end 118 to an opposing second end 120. Disposed at first end 118 is a tapered nose 122. A pair of annular slots 124 and 126 radially encircle meter stem 116 adjacent to tapered nose 122. Slits 124 and 126 are separated by a wall 128. A wall 130 separates slot 124 from nose 122. Disposed within each of slots 124 and 126 is an O-ring 134. O-rings 134 are configured to bias in sealed engagement against interior surface 140 of meter tube 110 when metering stem 116 is movable disposed therein. Second end 120 of metering stem 116 has a second set of threads 144.

As depicted in FIG. 6, metering steam 116 is disposed within chamber 112 of metering tube 110 so that threads 141 or meter tube 110 engage threads 144 of meter stem 116. As a result, manual rotation of stem 116 results in select advancement and retraction of metering stem 116 within chamber 112. Nose 122 of metering stem 116 is configured to engage control orifice 100. As such, when metering stem 116 is fully advanced within chamber 112, nose 122 occludes control orifice 100, thereby sealing off fluid communication between transition passageway 114 and mixing chamber 42. As metering stem 116 is gradually retracted, nose 122 separates from control orifice 100 gradually increasing the fluid flow path between transition pathway 114 and mixing chamber 92.

It can be appreciated that various other configurations of metering stem 116 can be identified by those skilled in the art. For example, metering stem 116 need not be threaded, while adjustment knob 80 includes a threaded portion that engages with meter tube 110 to control the position of nose 122 within control orifice 100. In yet another configuration, metering stem 116 engages with an intermediary gear or cog that cooperates with a slider rather than knob 80. In still yet another configuration, metering stem 116 include more than two O-rings 134 and associated slots 124 and 126.

As discussed later in greater detail, O-rings 134 in cooperation with slots 124 and 126 is one example of structure capable of performing the function of means for preventing air from passing between metering stem 116 and meter tube 110 when a negative pressure is produced within mixing chamber 92. Through use of the double O-ring configuration, the force of he pressure differential between the interior of valve body 15 and the external ambient pressure is divided between the O-rings, thereby preventing infiltration of the air.

Returning to FIG. 5, recessed within first end 82 of adjustment knob 80 is a first bore 146. A coaxially constricted second bore 148 extends past first bore 146. A coaxially constricted third bore 150 extends from second bore 148 to second end 84. Threads 152 are formed on the interior surface of third bore 150. A threaded hole 132 extends from side face 83 of adjustment knob 80 to second bore 148. A set screw 154 having a tip 156 is rotatably received within hole 132.

Depicted in FIG. 6, during assembly, second end 120 of metering stem 116 is passed through bores 146, 148 and tightly threaded into third bore 150 so that metering stem 116 and adjustment knob 80 are rigidly secured together. Metering stem 116 is threaded into chamber 112 of meter tube 110 by rotation of adjustment knob 80. In this configuration, meter tube 110 is at least partially disposed within both first bore 146 and second bore 148. Set screw 154 is then advanced within hole 132 so that tip 156 projects into second bore 148. Tip 156 thus acts as a stop by biasing against annular lip 111 so as to prevent stem 116 form accidentally unscrewing from meter tube 110. During replacement of control assembly 79 with control assembly 79*b,* set screw 154 is removed enabling control assembly 79 to be easily unscrewed and replaced.

In one embodiment, an annular spring 137 encircles meter tube 110 and is at least partially disposed within first bore 146 of adjustment knob 80. Spring 138 provides a resilient biasing force between valve housing 17 and adjustment knob 80. Additionally, if desired, an insulative cover 139 can be removably received over adjustment knob 80.

1. Adjustment knob 80 can have various forms and configurations as known by one skilled in the art. For example, adjustment knob 80 can include threads formed to cooperate with meter tube 110 to control the engagement of metering stem 116. In another configuration, adjustment knob 80 includes a plurality of holes 132 and associated set screws 154. In yet another configuration, adjustment knob 80 does not include set screw 154 but has some other means for selectively preventing rotation of knob 80. In yet another configuration, adjustment knob 80 takes the form of a slider. Another configuration includes a plurality of adjustment knobs 80 coupled to meter valve 14.

Referring again to FIG. 5, a tubular insert 106 has a first end 158 and an opposing second end 160. An interior surface 162 bounds a passageway 108 extending between ends 158 and 160. Threads 164 are positioned on the exterior surface of insert 106 at second end 160. As depicted in FIG. 6, first end 158 is disposed within siphon recess 104 such that passageway 108 communicates with transition passageway 14. Insert 106 can be either removably secured within siphon recess 104, such as by threaded engagement, or fixedly secured, such as by adhesive or some form of welding. Second end 160 of insert 106 forms siphoning end 30 of metering valve 14 as previously discussed with regard to FIG. 2. As such, attachment fitting 50 and siphon tube 68 couple therewith as previously discussed.

In operation, an individual couples adapter assembly 24 to inlet end 26 of valve housing 17. In turn a hose is coupled with adapter assembly 24 so as to deliver a first fluid. A second fluid concentrate is poured within container 12. Container 12 is then coupled with metering valve 14 by the attachment with cap 62. Depending on the pressure at which the first fluid is to be delivered to metering valve 14, a specific control assembly 79 having an adjustment knob 80 with corresponding indicia 90 is secured to valve body 14. Depending on the desired ratio for mixing the first fluid with the second fluid, adjustment knob 80 is selectively rotated so that a corresponding indicia 90 is aligned with alignment mark 86.

As the pressurized first fluid is delivered to metering valve 14, the first fluid is compressed as it flows through inlet passageway 96 into mixing chamber 92. The first fluid then expands as it passes out though discharge passageway 94. As a result of this compression and expansion, a venturi is created at mixing chamber 92 that sucks the second fluid from container 12 through siphoning tube 68, passageway 108, transition passageway 114, control orifice 100, and into mixing chamber 92. As the second fluid concentrate enter mixing chamber 92, it mixes with the first fluid and exits through discharge passageway 94.

As a result of the relatively high pressure at which the first fluid is provided, typically greater than about 200 psi, a strong venturi or negative pressure is produced within mixing chamber 92. This negative pressure attempts to suck in the surrounding air between metering stem 116 and meter tube 110. The double O-rings 134 effect a seal between metering stem 116 and meter tube 110 that prevents the passage of air therebetween.

The present invention may be embodied in other specific forms without departing from the spirit or essential characteristics. The described embodiments are to be considered in all respect only illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A metering valve configured to mix a first fluid with a second fluid, the metering valve comprising:

(a) a valve body bounding a mixing chamber and having:

(i) an inlet passageway extending from the exterior to the mixing chamber, the inlet passageway being configured to deliver the first fluid the mixing chamber under pressure;

(ii) a discharge passageway extending from the mixing chamber to the exterior;

(iii) a stem compartment in fluid communication with the mixing chamber through a control orifice;

(iv) a transition passageway in fluid communication with the stem compartment, the transition passageway being configured to deliver the second fluid to the mixing chamber through the control orifice; and (v) a stationary alignment mark located on an exterior surface thereof;

(b) a metering stem movably disposed within the stem compartment, the metering stem being configured to selectively control the flow of the second fluid from the transition passageway to the mixing chamber by selectively advancing and retracting within the stem compartment; and (c) an adjustment knob having a side face with a plurality of spaced apart indicia identifying discrete ratios of the first fluid to the second fluid, the adjustment knob being coupled with the metering stem such that alignment of a select indicia chosen from the plurality of indicia with the stationary alignment mark displaces the metering stem relative to the control orifice so that the first fluid and the second fluid feed into the mixing chamber at the ratio identified by the select indicia, the adjustment knob having a substantially cylindrical configuration with the side face encircling the adjustment knob and longitudinally extending between a first end to an opposing second end, the indica being disposed on the side face adjacent to the first end so as to at least partially encircle the adjustment knob at spaced apart locations, the adjustment knob further including (i) a first metering mark disposed on the side face of the adjustment knob between a first select one of the indicia and the first end of the adjustment knob; and (ii) a second metering mark disposed on the side face of the adjustment knob between a second select one of the indicia and the second end of the adjustment knob, the second alignment mark identifying a ratio of the first fluid and the second fluid after at least one full rotation of the adjustment knob.

2. The metering valve as recited in claim 1, wherein the metering stem includes two adjacently disposed annular slots radially encircling the metering stem, each annular slot having an O-ring disposed therein.

3. The metering valve as recited in claim 1, wherein the valve body includes a substantially cylindrical meter tube, the meter tube having an interior surface bounding a chamber extending therethrough, the chamber forming at least a potion of the stem compartment.

4. The metering valve as recited in claim 3, wherein the interior surface of the meter tube has threads formed thereon and the metering stem has an exterior surface with threads formed thereon, the metering stem being received in threaded engagement within the chamber of the meter tube.

5. A metering valve comprising:

(a) a valve body bounding a mixing chamber and having:

(i) an inlet passageway extending from the exterior to the mixing chamber;

(ii) a discharge passageway extending from the mixing chamber to the exterior;

(iii) a stem compartment having an interior surface and communicating with the mixing chamber through a control orifice; and (iv) a transition passageway communicating with the stem compartment;

(b) an elongated metering stem movably disposed within the stem compartment, the metering stem having a first end with a tapered nose formed thereat, an opposing second end having threads formed thereat, and at least two adjacently disposed annular slots radially encircling the metering stem between the tapered nose and the threads;

(c) an O-ring disposed within each of the annular slots on the metering stem, each O-ring being configured to bias in sealed engagement against the interior surface of the stem compartment when the metering stem is moved within the stem compartment; and (d) an adjustment knob coupled to the metering stem such that upon movement of the adjustment knob the metering stem selectively advances and retracts within the stem compartment so as to selectively control fluid communication between the transition passageway and the mixing chamber.

6. The metering valve as recited in claim 5, wherein the valve body includes an enlarged control recess extending from the exterior to the control orifice.

7. The metering valve as recited in claim 6, wherein the valve body includes a meter tube having a chamber extending therethrough, the meter tube having a first end and an opposing second end, the first end being coupled with the control recess such that the chamber is in fluid communication with the control orifice, the stem forming at least a portion of the stem compartment.

8. The metering valve as recited in claim 7, wherein the meter tube is configured to threadedly receive the metering stem within the chamber thereof.

9. The metering valve as recited in claim 7, further comprising an annular lip encircling and radially outwardly projecting from the second end of the meter tube.

10. The metering valve as recited in claim 9, wherein the adjustment knob has an interior compartment having the second end of the meter tube received therein, a set screw mounted on the adjustment knob is configured to bias against the lip of the meter tube.

11. A valve system configured to mix a first fluid with a second fluid, the valve system comprising:

(a) a valve body bounding a mixing chamber and having:

(i) an inlet passageway extending from the exterior to the mixing chamber, the inlet passageway being configured to deliver the first fluid to the mixing chamber under a plurality of different pressures;

(ii) a discharge passageway extending from the mixing chamber to the exterior;

(iii) a stem compartment in fluid communication with the mixing chamber through a control orifice;

(iv) a transition passageway in fluid communication with the stem compartment, the transition passageway being configured to deliver the second fluid to the mixing chamber through the control orifice; and (v) a stationary alignment mark located on an exterior surface thereof;

(b) a first control assembly including a first adjustment knob having an elongated metering stem projecting therefrom, the first control assembly being configured to selectively couple with the valve body such that rotation of the first adjustment knob selectively moves the metering stem within the stem compartment so as to selectively control the flow of the second fluid to the mixing chamber, the first adjustment knob having a side face with a plurality of spaced apart indicia identifying discrete ratios of the first fluid to the second fluid for a first select pressure of the first fluid, the first select pressure being chosen from the plurality of different pressures; and (c) a second control assembly including a second adjustment knob having an elongated metering stem projecting therefrom, the second control assembly being configured to selectively couple with the valve body such that rotation of the second adjustment knob selectively moves the metering stem within the stem compartment so as to selectively control the flow of the second fluid to the mixing chamber, the second adjustment knob having a side face with a plurality of spaced apart indicia identifying discrete ratios of the first fluid to the second fluid for a second select pressure of the first fluid, the second select pressure being chosen from the plurality of different pressures, the first control assembly and second control assembly being selectively interchangeable for independent use with the valve body.

12. The valve system as recited in claim 11, wherein the discharge passageway radially outwardly expands to create a venturi that sucks the second fluid into the mixing chamber when the first fluid passes through the discharge passageway.

13. An injection spraying system configured to mix and spray a first fluid with a second fluid, the system comprising:

(a) a container having a compartment configured to hold the second fluid;

(b) a valve housing removably coupled with the container, the valve housing having:

(i) a mixing chamber;

(ii) an inlet passageway extending from the exterior to the mixing chamber, the inlet passageway being configured to deliver the first fluid to the mixing chamber under pressure;

(iii) a discharge passageway extending from the mixing chamber to the exterior;

(iv) an enlarged control recess in fluid communication with the mixing chamber through a constricted control orifice; and (iv) a transition passageway in fluid communication with the control recess;

(c) a meter tube coupled to the control recess, the meter tube having an interior surface bounding a chamber passing therethrough, the chamber being in fluid communication with the control orifice, the meter tube having a substantially cylindrical exterior surface extending from a first end to an opposing second end, the first end being coupled with the valve housing, the second end having an annular lip radially outwardly projecting therefrom;

(d) a metering stem movably disposed within the chamber of the meter tube, the metering stem having a tapered nose configured to selectively engage the control orifice;

(e) an adjustment knob mounted to the metering stem such that rotation of the adjustment knob selectively advances and retracts the metering stem within the chamber of the meter tube; and (f) a siphoning tube having one end disposed within the compartment of the container and an opposing end in fluid communication with the transition passageway cooperating with the container and the valve body to thereby allow the second fluid to be drawn therefrom.

14. The injection spray system as recited in claim 13, further comprising:

(a) a stationary alignment mark disposed on an exterior surface of the valve housing; and (b) the adjustment knob having a side face with a plurality of spaced apart indicia identifying discrete ratios of the first fluid to the second fluid, the adjustment knob being coupled with the meter stem such that alignment of a select indicia chosen from the plurality of indicia with the stationary alignment mark displaces the metering stem relative to the control orifice so that the first fluid and the second fluid feed into the mixing chamber at the ratio identified by the select indicia.

15. The injection spray system as recited in claim 13, further comprising:

(a) the metering stem having at least two adjacently disposed annular slots radially encircling the metering stem; and (c) an O-ring disposed within each of the annular slots on the metering stem, each O-ring being configured to bias in sealed engagement against the interior surface of the compartment of the meter tube when the metering stem is moved within the compartment.

16. The injection spray system as recited in claim 13, wherein the metering stem is threadedly disposed within the meter tube.

17. The injection spray system as recited in claim 13, further comprising an adapter assembly in fluid communication with the inlet passageway of the valve housing.

18. The injection spray system as recited in claim 13, further comprising a dispensing hose in fluid communication with the discharge passageway of the of the valve housing.

19. A metering valve as recited in claim 5, wherein the metering stem has a central longitudinal axis in alignment with the mixing chamber.

20. A metering valve comprising:

(a) a valve body founding a mixing chamber and having:
  (i) an inlet passageway extending from the exterior to the mixing chamber;
  (ii) a discharge passageway extending from the mixing chamber to the exterior;
  (iii) a stem compartment having an interior surface and communicating with the mixing chamber through a control orifice;
  (iv) a meter tube having a chamber extending therethrough, the meter tube having a first end and an opposing second end, the first end being coupled with the valve body such that the chamber is in fluid communication with the control orifice, the chamber of the meter tube forming at least a portion of the stem compartment, an annular lip encircling and radially outwardly projecting from the second end of the meter tube; and
  (v) a transition passageway communicating with the stem compartment;

(b) an elongated metering stem movably disposed within the stem compartment, the metering stem having a annular first slot radially encircling the metering stem;

(c) a fist O-ring disposed within the annular first slot on the metering stem, the first O-ring being configured to bias in sealed engagement against the interior surface of the stem compartment when the metering stem is moved within the stem compartment; and (d) an adjustment knob coupled to the metering stem such that upon movement of the adjustment knob the metering stem selectively advances and retracts within the stem compartment so as to selectively control fluid communication between the transition passageway and the mixing chamber.

21. A metering valve as recited in claim 20, further comprising:

(a) an annular second slot radially encircling the metering stem; and (b) a second O-ring disposed within the annular second slot on the metering stem.

22. A metering valve as recited in claim 20, wherein the metering stem has a first end with a tapered nose formed thereat and an opposing second end having threads formed thereat, the first and second annular slots being disposed between the first end and the opposing second end.

23. An injection spraying system configured to mix and spray a first fluid with a second fluid, the system comprising:

(a) a container having a compartment configured to hold the second fluid;

(b) a valve housing removably coupled with the container, the valve housing having:
  (i) a mixing chamber;
  (ii) an inlet passageway extending from the exterior to the mixing chamber, the inlet passageway being configured to deliver the first fluid to the mixing chamber under pressure;
  (iii) a discharge passageway extending from the mixing chamber to the exterior;
  (iv) an enlarged control recess in fluid communication with the mixing chamber through a constricted control orifice; and
  (iv) a transition passageway in fluid communication with the control recess;

(c) a meter tube coupled to the control recess, the meter tube having an interior surface bounding a chamber passing therethrough, the chamber being in fluid communication with the control orifice;

(d) a metering stem movably disposed within the chamber of the meter tube, the metering stem having a tapered nose configured to selectively engage the control orifice;

(e) an adjustment knob mounted to the metering stem such that rotation of the adjustment knob selectively advances and retracts the metering stem within the chamber of the meter tube; and (f) a siphoning tube having one end disposed within the compartment of the container and an opposing end in fluid communication with the transition passageway cooperating with the container and the valve body to thereby allow the second fluid to be drawn therefrom; and (g) a dispensing hose in fluid communication with the discharge passageway of the valve housing.

24. An injection spraying system as recited in claim 23, further comprising an adapter assembly in fluid communication with the inlet passageway of the valve housing.

25. An injection spraying system as recited in claim 24, wherein the adapter assembly comprises a tubular extension having a nozzle disposed at one end and a strainer disposed at an opposing end.

* * * * *

UNITED STATES PATENT AND TRADEMARK OFFICE

CERTIFICATE OF CORRECTION

PATENT NO. : 6,182,911 B1
DATED : February 6, 2001
INVENTOR(S) : Gordon K. Hanks and William D. Edwards It is certified that error appears in the above-identified patent and that said Letters Patent is hereby corrected as shown below:

Column 1,
Line 5, before "Jul. 2" change "file" to -- filed --
Lines 60 and 61, after "tips are" change "removable" to -- removably --

Column 4,
Line 34, after "Spray head 22" insert -- , --
Line 35, after "gun jet 18" insert -- , --
Line 50, after "such as" insert -- , --

Column 5,
Line 19, after "as a" change "top" to -- stop --
Line 63, before "through opening" change "feed" to -- fed --

Column 6,
Line 4, after "strainer 76" insert -- , --
Line 9, after "system 10" change "included" to -- includes --
Line 33, after "metals," delete "and"
Line 36, after "nozzle 32" change "are the remaining elements" to -- is the remaining element --
Line 54, after "such as" insert -- , --

Column 7,
Line 18, after "such as" insert -- , --
Line 53, after "In turn" insert -- , --

Column 8,
Line 15, after "knob 80" change "are" to -- is --
Line 31, after "for" change "nay" to -- any --
Line 67, after "configuration" insert -- , --

Column 9,
Line 2, after "moves" insert -- , --
Line 20, before "discharge" change "aligned, however," to -- aligned. However, --
Line 38, after "As such" insert -- , --
Line 45, after "end 130" change "are" to -- is --
Line 66, before "disposed" change "moveable" to -- movably --

UNITED STATES PATENT AND TRADEMARK OFFICE

CERTIFICATE OF CORRECTION

PATENT NO. : 6,182,911 B1
DATED : February 6, 2001
INVENTOR(S) : Gordon K. Hanks and William D. Edwards It is certified that error appears in the above-identified patent and that said Letters Patent is hereby corrected as shown below:

Column 10,
Line 12, after "orifice 100" insert -- , --
Line 30, after "force of" change "he" to -- the --
Line 52, after "stem 116" change "form" to -- from --
Line 55, after "is removed" insert -- , --

Column 11,
Line 24, after "In turn" insert -- , --

Column 15,
Line 32, after "a valve body" change "founding" to -- bounding --

Signed and Sealed this

Sixteenth Day of April, 2002

*Attest:*

*Attesting Officer*

JAMES E. ROGAN
*Director of the United States Patent and Trademark Office*